US006554727B1

(12) United States Patent
Armstrong et al.

(10) Patent No.: US 6,554,727 B1
(45) Date of Patent: Apr. 29, 2003

(54) DEFLECTION-RESISTANT ARROWHEAD HAVING BOTH FIXED AND MECHANICALLY EXPANDABLE BLADES

(75) Inventors: Garret Armstrong, Flint, MI (US); Dana R. Brackins, Montrose, MI (US); Jeffrey A. Pestrue, St. Louis, MI (US)

(73) Assignee: The Game Tracker, Inc., Flushing, MI (US)

( * ) Notice: Subject to any disclaimer, the term of this patent is extended or adjusted under 35 U.S.C. 154(b) by 0 days.

(21) Appl. No.: 09/810,284

(22) Filed: Mar. 16, 2001

(51) Int. Cl.[7] ..... F42B 6/08
(52) U.S. Cl. ..... 473/584; 473/583
(58) Field of Search ..... 473/583, 584

(56) References Cited

U.S. PATENT DOCUMENTS 4,940,246 A 7/1990 Stagg
5,178,398 A 1/1993 Eddy
5,322,297 A 6/1994 Smith
5,564,713 A 10/1996 Mizek et al.
5,803,844 A 9/1998 Anderson
5,879,252 A 3/1999 Johnson
6,015,357 A 1/2000 Rizza
6,322,464 B1 * 11/2001 Sestak ..... 473/583

* cited by examiner

*Primary Examiner*—John A. Ricci
(74) *Attorney, Agent, or Firm*—Carrier, Blackman & Associates, P.C.; William D. Blackman; Joseph P. Carrier

(57) ABSTRACT

A deflection-resistant arrowhead includes a support body with a fixed spear-point blade attached to the tip thereof, and a plurality of pivotally attached, mechanically expandable blades. The expandable blades include integrally formed spurs at end portions thereof, which are provided to extend outwardly from the front of the support body, adjacent the base of the fixed blade, when the expandable blades are closed. The support body has slots formed in the sides thereof, to receive the pivotally attached expandable blades. The support body is also slotted at the front central portion thereof to receive the base portion of the fixed blade. The expandable blades normally remain in a closed configuration thereof, by means of an elastic retaining ring located behind the spurs. Upon contact with a target, the outstanding spurs force the expandable blades to open, simultaneously moving the retaining ring rearwardly on the support body.

20 Claims, 3 Drawing Sheets

DEFLECTION-RESISTANT ARROWHEAD HAVING BOTH FIXED AND MECHANICALLY EXPANDABLE BLADES

BACKGROUND OF THE INVENTION

1. Field of the Invention

The present invention relates to arrowheads, used in connection with arrows, for the sport of archery or for hunting. More particularly, the present invention relates to a mechanically expandable broadhead having a single fixed, deflection-resistant spear-point blade at the tip thereof, in combination with multiple pivotally movable blades.

2. Description of the Background Art

People in the field of archery or bowhunting commonly use arrowheads for: (1) preserving the integrity of an arrow; (2) maintaining an accurate arrow flight pattern; and (3) creating a more effective means of harvesting game.

In the past, to maintain the integrity of an arrow, some type of metal has been provided at the arrow tip. Metals used for arrowhead manufacture include stainless steel and steel alloys. Titanium is also becoming fairly common in arrow tip manufacture.

While almost any metal arrowhead would suffice to preserve an arrow's structural integrity, one objective, among arrowhead makers, is to create an arrowhead that both maintains an accurate flight pattern, and maximizes the effectiveness of a strike, to allow the bow-hunting enthusiast to efficiently harvest game. An arrowhead with relatively small blades provides accurate arrow flight, but offers a less effective or efficient means of harvesting game. In contrast, an arrowhead with large blades gives the arrow a less effective flight pattern, but provides for a more effective strike and harvest.

Today, selected hunters and some archery enthusiasts use mechanically expandable broadhead-type arrowheads. The expandable blade arrowhead offers a combination of both accurate arrow flight and effective harvest ability, in a single arrowhead. Expandable blade arrowheads tend to be accurate during flight, since the arrowhead remains small in diameter. Upon contact with the target or game, the arrowhead expands in diameter as large blades spring open, creating a larger area of penetration, and consequently, a more effective harvest. In this type of arrowhead, expansion of the blades, from a stored position to a fully deployed position, is caused by the mechanical action of the arrowhead striking the target.

Several inventors have independently patented different designs for mechanically expandable arrowheads.

U.S. Pat. No. 4,940,246 to Stagg (1990) discloses a mechanically expandable arrow attachment and/or arrow head in which two actuator members protrude from opposite sides of a cylindrical central body. When the arrowhead of Stagg strikes a target, the actuator members open integrally attached cutting blades, which are initially folded into the central body. During deployment of the cutting blades, the actuator members move through the cylindrical body and emerge on the opposite side.

While the Stagg reference discloses the combination of a fixed arrow tip with mechanically expandable blades, the actuator members of Stagg are spaced significantly away from the fixed tip, requiring significant entry depth of the fixed tip into a target before the mechanical blades begin to expand. In addition, in the design of Stagg, the actuator members are located relatively close to the pivot point, providing a relatively small lever arm to pivotally move the blade.

U.S. Pat. No. 5,178,398 to Eddy (1993) discloses another use of expandable blades. A rubber band is positioned over two expandable blades, to keep the blades closed during an arrow's flight. The band's position also prohibits the opening of the blades until the arrowhead penetrates its target, as the blades must break the band to expand.

U.S. Pat. No. 5,803,848 to Anderson (1998) uses a tip-actuated method of deploying two retractable blades. However, in typical hunting conditions it is possible that debris could collect in the actuator lip of the arrowhead of this design, limiting the effectiveness of the arrow.

U.S. Pat. No. 6,015,357 to Rizza (2000) contains two opposed blades that can either remain stationary or become expandable, depending on the consumer's desired use.

Several arrowhead patents have been issued with expandable blades retained by an annular member, such as an O-ring or rubber band, during flight. U.S. Pat. No. 5,322,297 to Smith (1994), U.S. Pat. No. 5,564,713 to Mizek et al. (1996) and U.S. Pat. No. 5,879,252 to Johnson (1999) all contain expandable blades retained by an annular member; however, none of these arrowheads contain a fixed-in-place blade, to ensure that the arrowhead retains some level of effectiveness, in the event that the expandable blades fail to deploy.

It has been discovered that if the known expandable blade arrowheads do not hit directly on a solid target area, or if they strike a target at an angle, these arrows may become deflected rather than entering into the target. Expandable blade arrowheads have been known to "bounce off" or ricochet away from the target in some instances. In addition, expandable arrowheads of the known type may have a greater tendency to bounce off than standard arrows, because of the requirement of the target causing the blades to open mechanically.

While the known arrowheads have some utility for their intended purposes, a need remains for improvement in the arrowhead art. A need exists for an arrowhead having expandable blades, in which actuators for the expandable blades are situated close to a fixed blade at the tip of the arrowhead, in order to minimize the time between entry of the fixed blade and the beginning of deployment of the expandable blades.

SUMMARY OF THE INVENTION

The present invention provides an improved arrowhead, which features mechanically expandable blades, and which also includes a "cut-on-contact" spear-point blade, fixedly mounted at the tip of the arrowhead, to provide entry into the target before the expandable blades are deployed, in order to resist deflection of the arrowhead.

In the arrowhead according to a first embodiment of the present invention, expandable blade actuator spurs are situated close to a fixed blade at the tip of the arrowhead, in order to minimize the time between entry of the fixed blade and the beginning of deployment of the expandable blades.

An arrowhead, according to the first embodiment, includes a support body having a substantially conical tip portion, with a central slot formed therein to receive the fixed spear-point blade. The support body also has longitudinal slots formed in the sides thereof, which allows it to serve as a housing for two or more pivotally attached expandable blades.

At the base of the support body, a threaded shaft is provided to allow the arrowhead to be threadably and rotatably mounted in a threaded bore at the front of an arrow shaft.

The expandable blades are disposed in a semi-retracted configuration during arrow flight, with actuator spurs extending outwardly from the support body, proximate the base of the fixed blade.

The fixed spear-point blade may be a substantially diamond-shaped double-edged fixed blade, attached to the front of the support body in the central slot, between the expandable blades, to form the leading edge of the arrow tip. Alternatively, the fixed blade may be substantially teardrop-shaped. The cutting edges of the fixed blade may be flat and continuous, or may alternatively be made serrated.

Each blade is attached by a suitable fastener, which closely conforms to the exterior surface of the support body, to minimize wind resistance during flight. The fastener is preferably made removable, in order to allow the blades to be replaced, should they become damaged or worn. As noted, the arrowhead according to the first embodiment of the invention includes at least two pivotally movable and expandable blades. In an alternative embodiment, three or four expandable blades may be used.

The fastener for attaching the fixed front spear-point blade to the support body may be a screw. In a preferred embodiment, the fastener fits into a threaded bore, formed substantially transversely to the longitudinal axis of the support body. The fastener also passes through a pre-cut hole provided in the spear-point blade, to retain the blade in fixed relation to the support body.

Where two expandable blades are used, the blades may both be fastened to the support body with a single fastener. Alternatively, each of the expandable blades may be separately fastened to the support body.

Each of the fasteners, selected to interconnect one or more of the expandable blades to the support body, operates in a dual capacity. First, the fastener attaches one or more of the expandable blades to the support body. Second, it operates as the fulcrum on which the expandable blade pivots to its opened state.

During arrow flight, and when not in use, the expandable blades are retained in the closed configuration thereof by an elastic band or O-ring.

Each of the expandable blades includes a small, yet highly functional spur, which is situated at or near the leading edge of the expandable blade when it is in its closed configuration. The spurs extend outwardly beyond the support body while the blades are in the closed position. Preferably, in the closed configuration of the arrowhead, the spurs are situated at the forwardmost end of the expandable blades, adjacent the fixed blade at the tip of the support body.

The spurs' purpose is two-fold. First, the spurs help provide stability in the arrow's flight as they counter-balance the wind shear of the fixed blade; and second, upon the arrowhead's contact with the target, the spur impacts against the target surface, forcing the blade rearwardly. This rearward movement of the blades either breaks the elastic retaining ring or moves it rearwardly on the arrow shaft. Once the pivotally attached blades expand, the bases of the blades anchor against the support body slot, orienting the sharp cutting edges of the blades facing forwardly, to provide the maximum effective cutting surface.

It is an object of the present invention to provide a mechanically expandable broadhead which also includes a fixed blade at the tip portion thereof.

It is a further object of the invention to provide a mechanically expandable broadhead of the type described, in which a plurality of actuator spurs are located close to the fixed blade, to provide quick opening of the expandable blades shortly after the tip enters a target.

For a more detailed presentation of the invention, the following section offers a detailed description accompanied by drawings. Throughout the following detailed description and drawings, like numbers refer to like parts.

DETAILED DESCRIPTION OF THE PREFERRED EMBODIMENTS

Figure 1:
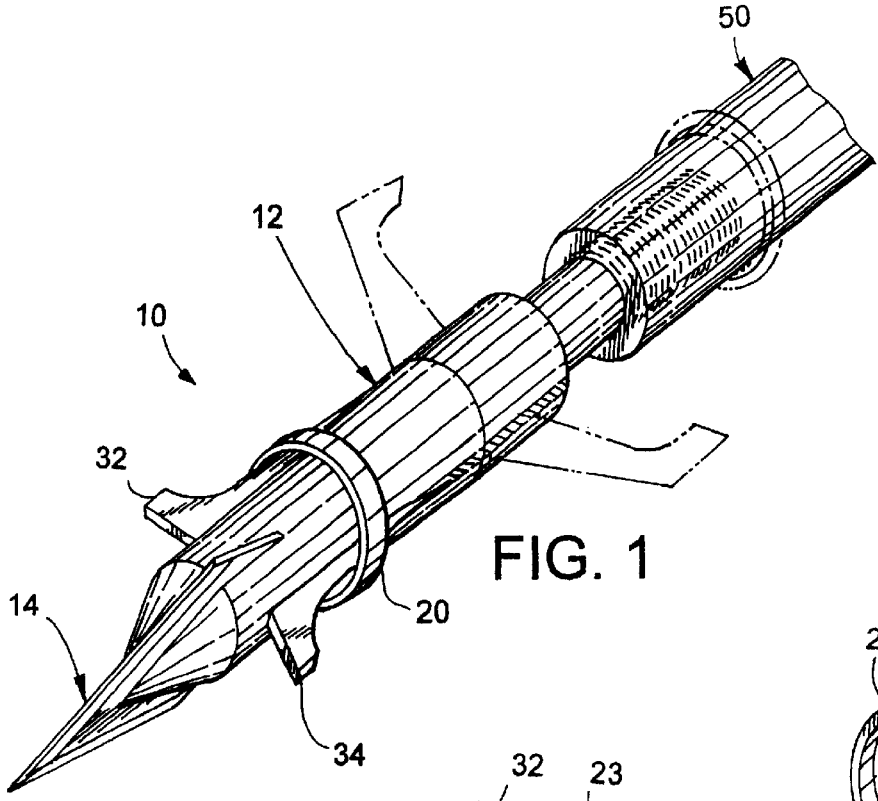
FIG. 1 is a perspective view of an expandable blade arrowhead according to a first embodiment of the invention, in a closed configuration thereof, with an open configuration of the expandable blades shown in phantom, and also showing a cut-away portion of an arrow shaft.
Figure 2:
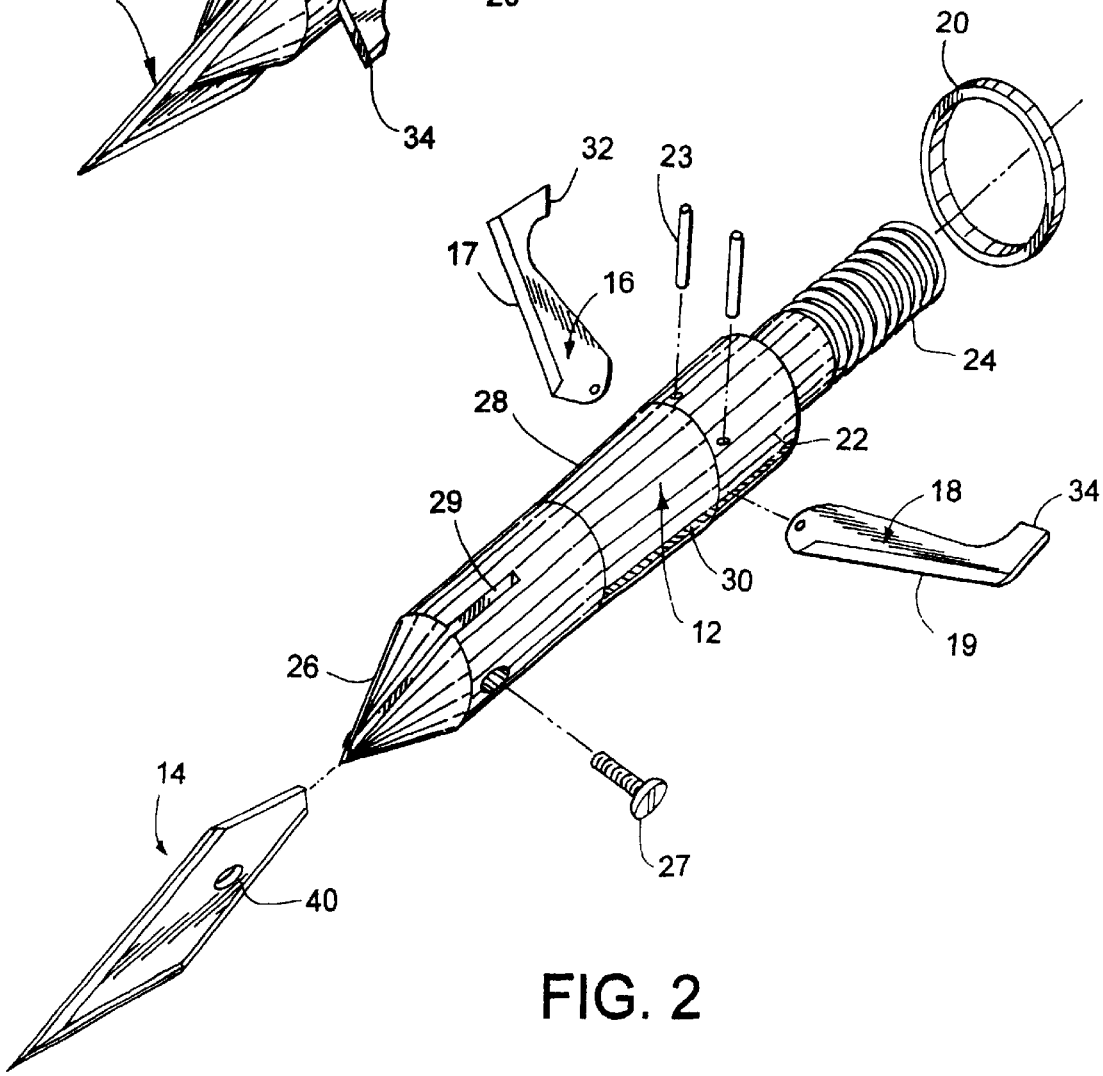
FIG. 2 is an exploded perspective view of the arrowhead of FIG. 1, showing the component parts thereof.

Referring to FIGS. 1–2 of the drawings, an expandable blade broadhead-type arrowhead, according to a first embodiment of the invention, is shown generally at 10. The arrowhead 10 includes a support body 12, which supports a fixed blade 14, a pair of opposed pivotally mounted blades 16, 18, and a stretchable rubber or elastic retaining ring 20.

The support body 12 includes a base 22, which has an integral threaded shaft 24 thereon for mounting the arrowhead 10 on an arrow shaft 50. The support body 12 also includes a substantially conical tip 26 opposite the base 22. The base 22 may be made of a larger diameter than the area of the support body adjacent the tip 26, for aerodynamic purposes, and for ease of entry of the support body 12 into a target.

The support body 12 makes up the main central structure of the arrowhead 10, and can be made from stainless steel, steel alloy, titanium, or other metal, depending on the desired grain.

Alternatively, the support body could be made from a durable and high-strength plastic material, although metals are preferred. The support body 12 will be made from these various materials, to provide archery enthusiasts and hunters with the specific grain (mass) for their desired application.

In the embodiment of FIGS. 1–4, the support body 12 has a pair of opposed side slots 28, 30 formed in the respective sides thereof, to accommodate two semi-concealed expandable blades 16, 18. (It will be understood that the arrowhead according to the invention may include three or four expandable blades similar to the blades 16, 18 in the drawing, and that such an increased number of blades would have a corresponding number of receiving slots formed in the support body and spaced evenly therearound.)

The support body also has a conical tip 26 at the front end thereof, with a center slot 29 formed therethrough the to receive the fixed blade 14.

Figure 3:
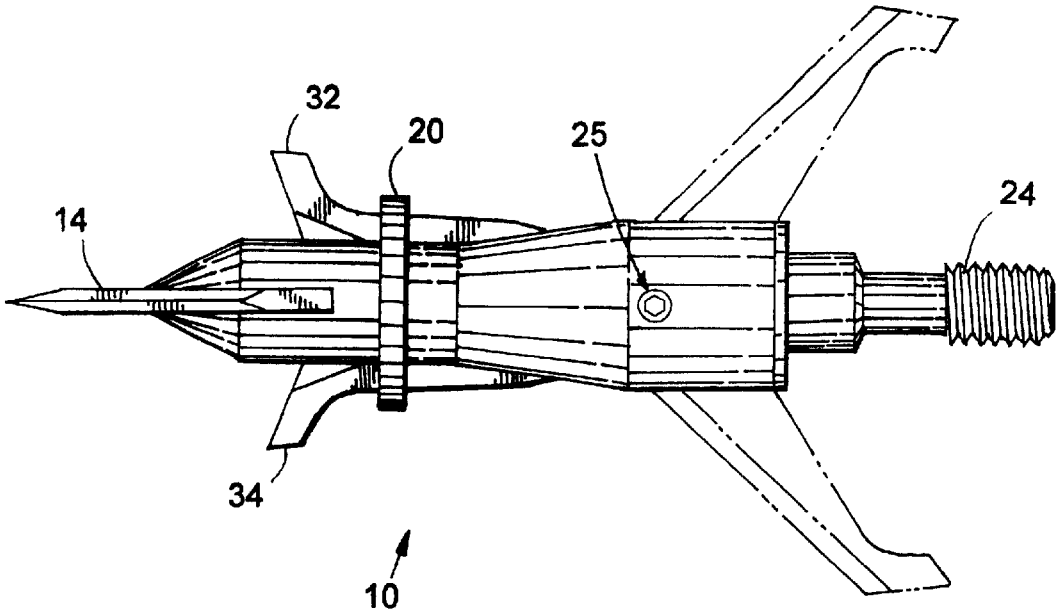
FIG. 3 is a top plan view of the arrowhead of FIG. 1, with the expandable blades in the closed position, and showing an open position of the blades in phantom.
Figure 4:
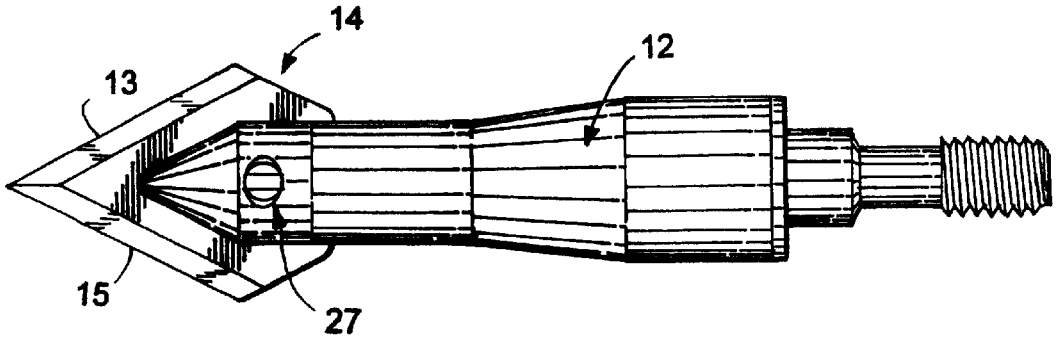
FIG. 4 is a side plan view of the arrowhead of FIG. 1, with the expandable blades omitted from the drawing for simplicity of illustration.

By slotting the support body 12, thus semi-concealing the expandable blades 16, 18, in the side slots 28, 30, in their closed configuration shown in FIGS. 1 and 3, the arrow's aerodynamics are improved. The expandable blades 16, 18 have sharpened edges 17, 19, which face inwardly in the side slots 28, 30 of the support body 6, while the blades are in the closed position. Placement of the respective sharpened edges 17, 19 of the expandable blades 16, 18 within the slots 28, 30 during storage and transport of the arrowhead 10 protects the sharpened edges from damage, oxidation, and/or premature wear. This also enables a hunter or archery enthusiast to carefully handle the arrowhead 10, with the blades closed, and to rotatably attach the arrowhead to the arrow shaft 50, with reduced risk of being cut.

The expandable blades 16, 18 are sharpened on both the top and bottom surfaces of the cutting edges 17, 19 thereof, to ensure maximum cutting ability. This sharpening creates machined surfaces adjacent the cutting edges 17, 19. In the practice of the present invention, the arrowhead 10 is constructed and arranged so that when the expandable blades 16, 18 are in the closed configuration thereof, the portion of each of the expandable blades behind and exclusive of its respective spur 32, 24 tapers inwardly as it moves rearwardly from the spur end towards the pivotally attached end thereof. This is a reflection of the fact that in the closed configuration, the expandable blades 32, 34 are oriented so that part of the machined portion thereof, proximate the spur, is visible, as shown in FIGS. 1 and 3. As a result, it will be understood that the expandable blades are oriented to open quickly when the arrowhead 10 strikes a target. Preferably, the fixed blade 14 and the expandable blades 16, 18 are all made of stainless steel.

Each of the expandable blades 16, 18 is also equipped with a respective spur 32, 34 at a freely movable end thereof. The spurs 32, 34 act as lever arms, to force open the expandable blades 16, 18, and to move the retaining ring 20 rearwardly on the support body 12, when the arrowhead 10 strikes a target. The spurs 32, 34 are preferred to have pointed tips, as shown.

In the closed configuration of the blades 16, 18 shown in FIG. 1, the spurs 32, 34 are situated at or near a forwardmost leading edge of the blades near the fixed blade 14 at the tip 26 of the support body, and the spurs extend outwardly away from the support body, as shown. This forward-facing location of the spurs 32, 34 is important, because it enables the expanding blades 16, 18 to begin their deployment shortly after the fixed blade 14 penetrates into a target.

Each of the expandable blades 16, 18 respectively, has a hole formed through a rounded end thereof, opposite the spur. These inner ends of the blades are rounded in order to allow free rotation of the blades around a pivot point provided by a mounting fastener 23 or 25, as will be further described herein. The rounded end of each respective blade 16, 18 may include a flat portion provided to act as a stop, so as to limit rearward movement of the blade.

The blades 16, 18 are affixed to the support body 12, by an appropriate fastener 23, such as a screw or roll pin. The fastener 23 passes through one side of the support body 12, and also passes through the pre-drilled holes of the expandable blades 16, 18. The fastener 23 provides the pivot point upon which the expandable blades move. Each of the blades 16, 18 may be independently attached to the support body 12 with a separate fastener 23, as shown in FIG. 2.

Alternatively, slots 28, 30 may connect to one another within the support body 12, the rounded ends of the expandable blades 16, 18 may be placed overlapping one another, and in this case, both blades may be attached to the support body using a single fastener, such as the Allen screw 25 shown in FIG. 3. Where an Allen screw 25 is used, it may, optionally, be formed with an integral reduced diameter pin provided at the end thereof, for placing through the holes in the rounded ends of the blades 16, 18.

The arrowhead 10 also includes the fixed blade 14, which is rigidly attached to the support body 12 adjacent the tip 26 thereof. The fixed blade 14 includes a base portion which is substantially continuous and uninterrupted, as shown in FIG. 2. In the embodiment of FIGS. 1–4, the fixed blade 14 is substantially diamond-shaped, with one endpoint truncated, as shown. Also in this embodiment, each cutting edge 13, 15, at the forward end of the blade, is sharpened on both sides thereof, as shown in FIG. 3. The fixed blade 14 is made of stainless steel and has a pre-drilled hole 40 formed therethrough for purposes of attachment. The fixed blade 14 attaches to the support body 12, by placing the base portion thereof into the central slot 29 at the front of the support body 12. The fixed blade 14 is attached to the support body using an appropriate fastener such as a screw 27, which passes through one side of the support body 12, slides through the pre-drilled hole 40 in the fixed blade 14, and continues being threaded through the support body 12, without reaching the opposing side, due to its carefully selected length.

Figure 5:
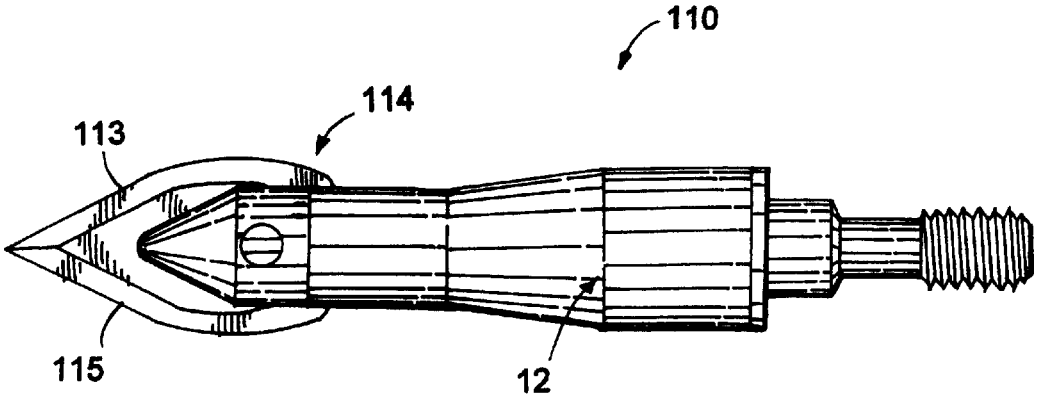
FIG. 5 is a side plan view of an arrowhead, similar to FIG. 4 but including a teardrop-shaped fixed blade, according to a second embodiment of the invention.

FIG. 5 illustrates an alternative embodiment of an arrowhead 110 according to the invention. In this embodiment, every feature of the arrowhead 110 is identical to the first embodiment 10, except as specifically described as different herein. In the arrowhead 110 of FIG. 5, the fixed blade 114 is substantially teardrop-shaped, and each of the respective cutting edges 113, 115 of the fixed blade includes a portion which defines a substantially curved line, as shown.

Figure 6:
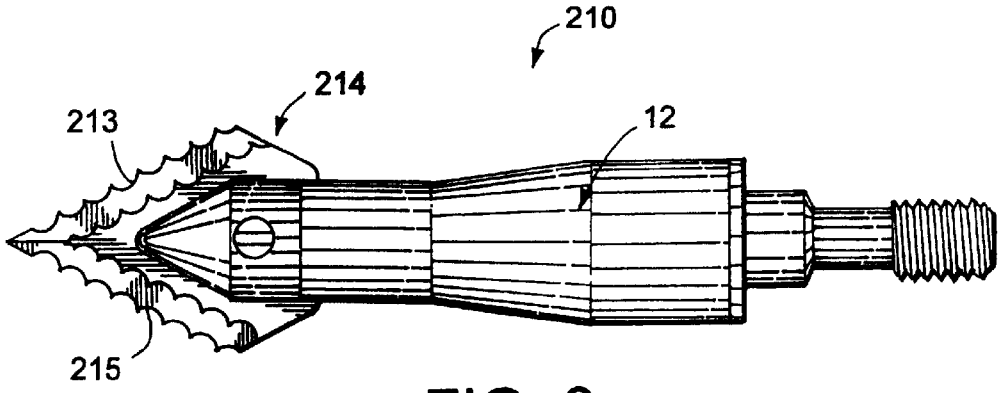
FIG. 6 is a side plan view of an arrowhead, similar to FIG. 4 but including a fixed blade having a serrated edge, according to a third embodiment of the invention.

FIG. 6 illustrates another alternative embodiment of an arrowhead 210 according to the invention, identical to the arrowhead 10 of FIGS. 1–4, except that in this embodiment, the cutting edges 213, 215 of the fixed blade 214 are serrated.

Figure 7:
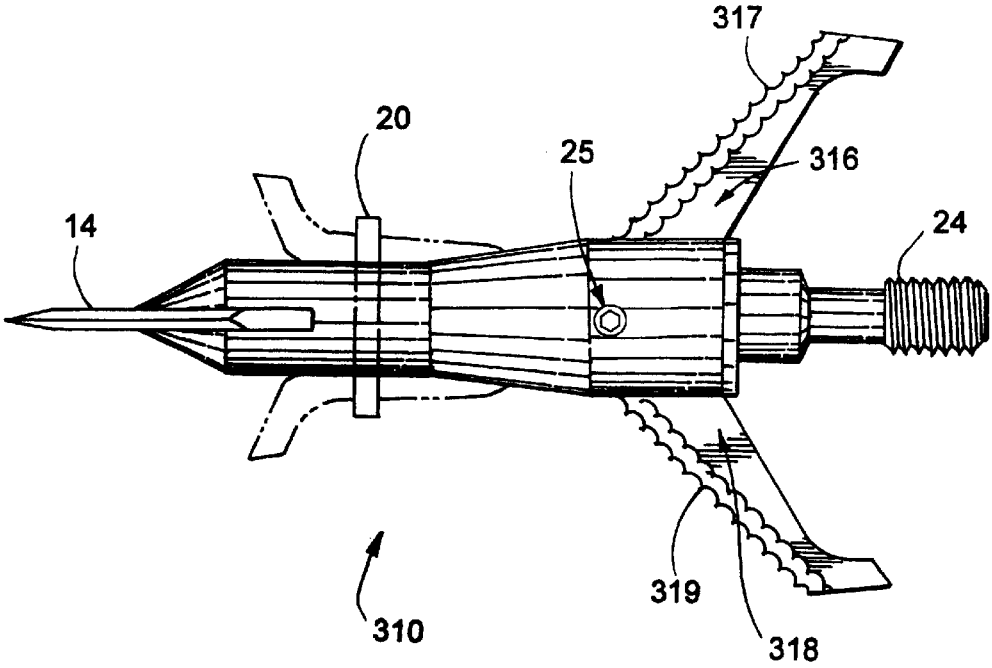
FIG. 7 is a top plan view of an arrowhead according to a fourth embodiment of the invention, with the expandable blades in the open position, and showing a closed position of the blades in phantom.

FIG. 7 illustrates still another alternative embodiment of an arrowhead 310 according to the invention, identical to the arrowhead 10 of FIGS. 1–4, except that in this embodiment, the cutting edges 317, 319 of the movable blades 216, 218 are serrated.

Although several embodiments of the present invention have been described with specificity herein, the foregoing description is intended to be an illustration, and not a restriction in the scope of the invention. Those skilled in the art will realize that many modifications of the embodiment could be made which would be operable. All such modifications, which are within the scope of the claims, are intended to be within the scope and spirit of the present invention.

Having, thus, described the invention, what is claimed is:

1. An arrowhead, comprising:

a support body having a central longitudinal axis, said support body having at least two longitudinally extending side slots formed therein, said support body comprising a base and a tip end opposite the base and with a substantially planar center slot formed centrally therein;

a fixed blade which is fixedly attached to said support body and which includes a base portion for placement within said center slot of said support body, said base portion of said fixed blade being substantially continuous and uninterrupted, said fixed blade being wider than said support body; and first and second expandable blades which are pivotally attached to the support body, said expandable blades having cutting edges formed on selected surfaces thereof, each of the expandable blades comprising a first end having a hole formed therethrough for attaching to said support body, and a second end opposite said first end, wherein said second end has a spur formed thereon for extending outwardly from said support body, proximate the base portion of said fixed blade, when said expandable blades are in a closed configuration thereof;

wherein said expandable blades are pivotally movable between a closed configuration, in which said cutting edges are disposed in the side slots of said support body, and an open configuration in which said blades extend outwardly from said support body with said cutting edges exposed.

2. The arrowhead of claim 1, further comprising an elastic retaining ring surrounding said expandable blades and said support body, said retaining ring being operable to temporarily retain said expandable blades in said closed configuration thereof.

3. The arrowhead of claim 2, wherein said expandable blades are operable to move said retaining ring rearwardly on to an arrow shaft when said arrowhead strikes a target.

4. The arrowhead of claim 1, wherein each of said cutting edges of said fixed blade comprises a portion which defines a substantially straight line.

5. The arrowhead of claim 1, wherein each of said cutting edges of said fixed blade comprises a portion which defines a substantially curved line.

6. The arrowhead of claim 1, wherein said cutting edges of said fixed blade are serrated.

7. The arrowhead of claim 1, wherein said fixed blade is a substantially flat member.

8. The arrowhead of claim 1, wherein said support body has a hollow bore formed therein substantially transverse to said longitudinal axis of said hollow body, wherein said fixed blade has a hole formed through the base thereof, and further comprising a threaded fastener which passes through said hole in said fixed blade and threadably engages in said hollow bore.

9. The arrowhead of claim 1, wherein the side slots of the support body are substantially perpendicular to the central slot thereof.

10. The arrowhead of claim 1, further comprising a threaded fastener, wherein both of said expandable blades are pivotally attached to said support body by said threaded fastener.

11. The arrowhead of claim 1, further comprising first and second pivot pins, wherein said first and second expandable blades are respectively independently pivotally attached to said support body by said respective first and second pivot pins.

12. An arrow, comprising an arrow shaft, and the arrowhead of claim 1 attached to the arrow shaft.

13. The arrowhead of claim 1, further comprising a third expandable blade.

14. The arrowhead of claim 1, wherein the expandable blades are affixed to the support body by at least one removable fastener, whereby said expandable blades can be removed or replaced.

15. The arrowhead of claim 1, wherein the fixed blade is affixed to the support body by a removable fastener, whereby said fixed blade can be removed or replaced.

16. The arrowhead of claim 1, wherein the cutting edges of said expandable blades are serrated.

17. An arrowhead, comprising:

a support body having a central longitudinal axis, said support body having at least two longitudinally extending side slots formed therein, said support body comprising a base and a tip end opposite the base and with a substantially planar center slot formed centrally therein;

a fixed blade which is fixedly attached to said support body and which includes a base portion for placement within said center slot of said support body, said fixed blade being wider than said support body;

first and second expandable blades which are pivotally attached to the support body, said expandable blades having cutting edges formed on selected surfaces thereof; each of the expandable blades comprising a first end having a hole formed therethrough for attaching to said support body, and a second end opposite said first end, wherein said second end has a spur formed thereon for extending outwardly from said support body, proximate the base portion of said fixed blade, when said expandable blades are in a closed configuration thereof;

said expandable blades being pivotally movable between a closed configuration, in which said cutting edges are disposed in the side slots of said support body and in which said spurs define the forwardmost portion of the expandable blades, and an open configuration in which said blades extend outwardly from said support body with said cutting edges exposed;

wherein each of said expandable blades has a machined portion proximate said cutting edge, and wherein part of said machined portion of each expandable blade, proximate said spur, is visible when said expandable blades are in the closed configuration thereof; and an elastic retaining ring surrounding said expandable blades and said support body, said retaining ring being operable to temporarily retain said expandable blades in the closed configuration thereof.

18. An arrowhead, comprising:

a support body having a central longitudinal axis, said support body having at least two longitudinally extending side slots formed therein, said support body comprising a base and a tip end opposite the base and with a substantially planar center slot formed centrally therein;

a fixed blade which is fixedly attached to said support body and which includes a base portion for placement within said center slot of said support body, said fixed blade being wider than said support body; and first and second expandable blades which are pivotally attached to the support body, said expandable blades having cutting edges formed on selected surfaces thereof, each of the expandable blades comprising a first end having a hole formed therethrough for attaching to said support body, and a second end opposite said first end, wherein said second end has a spur with a pointed tip formed thereon for extending outwardly from said support body, proximate the base portion of said fixed blade, when said expandable blades are in a closed configuration thereof;

wherein said expandable blades are pivotally movable between a closed configuration, in which said cutting edges are disposed in the side slots of said support body, and an open configuration in which said blades extend outwardly from said support body with said cutting edges exposed;

and further wherein each of said expandable blades has a machined portion proximate said cutting edge, and wherein part of said machined portion of each expandable blade, proximate said spur, is visible when said expandable blades are in the closed configuration thereof.

19. An arrowhead, comprising:

a support body having a central longitudinal axis, said support body having at least two longitudinally extending side slots formed therein, said support body comprising a base and a tip end opposite the base and with a substantially planar center slot formed centrally therein;

a fixed blade which is fixedly attached to said support body and which includes a base portion for placement within said center slot of said support body, said fixed blade being wider than said support body; and first and second expandable blades which are pivotally attached to the support body, said expandable blades having cutting edges formed on selected surfaces thereof, each of the expandable blades comprising a first end having a hole formed therethrough for attaching to said support body, and a second end opposite said first end, wherein said second end has a spur with a pointed tip formed thereon for extending outwardly from said support body, proximate the base portion of said fixed blade, when said expandable blades are in a closed configuration thereof;

wherein said expandable blades are pivotally movable between a closed configuration, in which said cutting edges are disposed in the side slots of said support body, and an open configuration in which said blades extend outwardly from said support body with said cutting edges exposed;

and further wherein each of said expandable blades has a machined portion proximate said cutting edge, and wherein part of said machined portion of each expandable blade, proximate said spur, is visible when said expandable blades are in the closed configuration thereof.

20. The arrowhead of claim 19, wherein said arrowhead is constructed and arranged so that when the expandable blades are in the closed configuration thereof, the portion of each of said expandable blades behind and exclusive of said spur tapers inwardly as it moves from the second end towards the first end thereof.

* * * * *

UNITED STATES PATENT AND TRADEMARK OFFICE

CERTIFICATE OF CORRECTION

PATENT NO. : 6,554,727 B1 
DATED : April 29, 2003
INVENTOR(S) : Garret L. Armstrong, Dana R. Brackins and Jeffrey A. Pestrue It is certified that error appears in the above-identified patent and that said Letters Patent is hereby corrected as shown below:

Title page,
Item [75], Inventors, change "Garret Armstrong, Flint, MI (US);" to -- Garret L. Armstrong, Flint, MI (US); --.

Column 5,
Line 7, change "thereof, with a center slot 29 formed therethrough the to" to -- thereof, with a center slot 29 formed therethrough to --.
Line 31, change "sive of its respective spur 32, 24 tapers inwardly as it moves" to -- sive of its respective spur 32, 34 tapers inwardly as it moves --.

Figure 8:
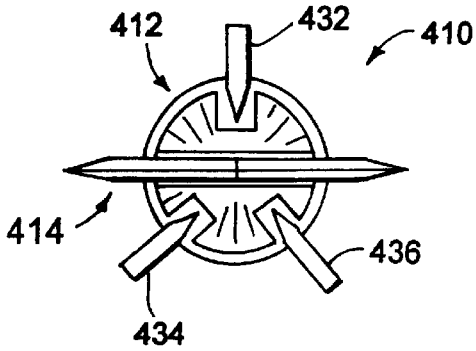
FIG. 8 is a front end plan view of an arrowhead according to a fifth embodiment of the invention, showing the blades closed.

Column 6,
Between lines 53 and 54, insert the following paragraph:
-- Figure 8 illustrates yet another embodiment of an arrowhead 410 according to the invention, identical to the arrowhead 10 of Figures 1-4, except that in this embodiment, the support body 412 has three evenly spaced slots formed therein. A fixed blade 414 is provided which is substantially identical to the fixed blade 14 in the first embodiment. Three expandable blades 432, 434 and 436 are pivotally attached to the support body 412, and fit into the slots thereon. --.

Signed and Sealed this

Seventeenth Day of February, 2004

JON W. DUDAS
*Acting Director of the United States Patent and Trademark Office*